US007493862B2

(12) United States Patent
Orlanov

(10) Patent No.: US 7,493,862 B2
(45) Date of Patent: Feb. 24, 2009

(54) JACKET BULLETS

(76) Inventor: Farrel Orlanov, 59 Bodley Road, Laezonia, Centurion 0026 (ZA)

( * ) Notice: Subject to any disclaimer, the term of this patent is extended or adjusted under 35 U.S.C. 154(b) by 15 days.

(21) Appl. No.: 11/497,369

(22) Filed: Aug. 2, 2006

(65) Prior Publication Data

US 2008/0156222 A1 Jul. 3, 2008

(51) Int. Cl.
*F42B 12/78* (2006.01)

(52) U.S. Cl. ..... 102/514; 102/439

(58) Field of Classification Search ..... 102/514, 102/501, 507, 511, 515, 516, 439
See application file for complete search history.

(56) References Cited

U.S. PATENT DOCUMENTS 4,674,409 A * 6/1987 Lopata et al. ..... 102/471
5,216,199 A * 6/1993 Bjerke et al. ..... 102/471
5,275,108 A * 1/1994 Chernicky et al. ..... 102/439
5,399,187 A * 3/1995 Mravic et al. ..... 75/228
5,490,463 A * 2/1996 Lamberty et al. ..... 102/439
6,959,648 B2 * 11/2005 Piela ..... 102/511
2006/0027128 A1 * 2/2006 Hober ..... 102/514

* cited by examiner

*Primary Examiner*—James S Bergin
(74) *Attorney, Agent, or Firm*—Birch, Stewart, Kolasch & Birch, LLP

(57) ABSTRACT

This invention relates to ammunition. More specifically, this invention is related to rimfire ammunition cartridges with heeled bullets, such as .22 long rifle ammunition cartridges. The invention extends to a heeled bullet for use in such ammunition.

18 Claims, 2 Drawing Sheets

10
Ø5,67 +0 -0,02
Ø5,27 +0 -0,04
23
R2,03
5,85 ± 0,05
20
9,30
R12,7
R0,15
MAX
21
16
22
14
2,40 / 2,60
12
19
18
Ø5,30 +0 -0,01

JACKET BULLETS

FIELD OF THE INVENTION

This invention relates to ammunition. More specifically, this invention relates to rimfire ammunition cartridges with heeled bullets, such as .22 long rifle ammunition cartridges. The invention extends to a heeled bullet for use in such ammunition.

BACKGROUND TO THE INVENTION

In rimfire ammunition cartridges, the cartridge casing has a flanged rim at its closed end or base. The opposed end of the casing is open and a lead bullet is fitted therein. Primer is provided at the rim and the rest of the shell contains a propellant. The cartridge is fired when a striking pin strikes the rim of the shell, deforming the rim and igniting the primer. The primer in turn ignites the propellant and expanding gasses cause the bullet to be propelled out of the shell and down the barrel of the firearm. Because the rim of the shell is deformed during firing, rimfire cartridge casings are not reusable.

Another major type of ammunition cartridge in use today is the centerfire cartridge. Here, the primer is provided in a replaceable priming cap located in the center of the cartridge casing base. The primer is ignited when a striking pin strikes the priming cap. In centerfire cartridges, the cartridge casing can be reused by reloading the bullet, propellant and priming cap. This is an advantage for large-caliber ammunition, where the cartridge casing may be quite expensive. Because the propellant of rimfire ammunition is ignited by deformation of the rim of the cartridge casing, the rim is weakened on firing. This limits the pressure to which the cartridge casing can be subjected. For this reason, rimfire ammunition is unsuitable for most higher caliber and higher pressure ammunition, and has been all but abandoned except in .22 caliber ammunition where the economic benefit of the rimfire design outweighs its disadvantages.

The bullet of an ammunition cartridge generally has a cylindrical body portion, a flat back end at its base and a pointed nose or tip. The base of the bullet may be of a heeled or a non-heeled design.

In non-heeled bullets, the cylindrical body portion extends uniformly to the base of the bullet, so that the diameter of the bullet at its base is essentially equivalent to the diameter of the bullet at the body portion. The maximum diameter of the non-heeled bullet must therefore be smaller than the diameter of the cartridge casing at its open end, to allow the base of the bullet to fit into the cartridge casing. The advantage of non-heeled bullets is that the bullet can be lubricated with wax or grease on the base portion that is received within the cartridge casing, thereby protecting the wax or grease lubrication from contamination. A further advantage of this design is that, because the cylindrical body portion extends all the way to the base of the bullet, the bullet has a relatively long surface that bears against the barrel of the firearm, resulting in a good gas seal between the bullet and the barrel.

In heeled bullets, however, the base portion of the bullet is inwardly stepped to form a heel having a narrower diameter than the diameter of the body portion of the bullet. The heel portion of the bullet is received within the open end of the cartridge casing so that the body portion is flush with, and of the same diameter as, the cartridge casing at its open end. The entire cartridge is chambered in the barrel of a firearm, in use, and this has the advantage that ammunition cartridges of different lengths can be used in the same firearm. Heeled bullets are typically used in rimfire ammunition, such as .22 caliber ammunition. A disadvantage of heeled bullets, however, is that the exposed portion of the bullet must be lubricated with a grease or wax to avoid lead residue build up in the barrel of the firearm and this exposed lubricant is easily contaminated.

Another disadvantage of heeled bullets is that, when the bullet is expelled from the cartridge casing, the heel of the bullet is deformed and expands or "sets-up" to form part of the surface that bears against the barrel. The degree of set-up of the heel depends on the firing pressure. If the firing pressure is low, the heel will not set-up sufficiently to bear against the barrel, resulting in a potentially poor gas seal with resultant low accuracy. If the firing pressure is too high, the heel of the bullet may crack or rupture, affecting the centre of mass and bearing surface of the bullet and also resulting in poor accuracy. It is also possible that the heel may still be expanding when the bullet leaves the barrel of the firearm, with potentially uneven expanding forces resulting in destabilization of the flight trajectory of the bullet. Furthermore, hot gasses expelled by the propellant erode the base of the bullet, causing inconsistencies in the bullet that affect its balance and flight path.

Unjacketed bullets have all of the disadvantages set out above. It is known to provide a coating for a lead bullet by means of an electo-plating process. However, this coating is too thin to overcome the disadvantages set out and also varies in thickness, leading to inaccuracy.

OBJECT OF THE INVENTION

It is an object of the invention to provide a heeled bullet for use in a rimfire ammunition cartridge in which external lubrication of the bullet is not required. It is a further object of the invention to provide a heeled bullet for use in a rimfire ammunition cartridge in which the heel does not substantially set-up or expand during firing. It is a yet further object of the invention to provide a heeled bullet for use in a rimfire ammunition cartridge that at least partially overcomes some of the above-mentioned disadvantages and has at least some of the advantages set out.

SUMMARY OF THE INVENTION

In this specification, the phrase "heavy metal jacket" is to be given a wide meaning to include a metal jacket of any thickness that is not applied by a plating or similar process. Generally, an electo-plating process will produce a coating of a thickness of between about 4 μm and 12 μm, commonly about 8 μm. A metal jacket as described in this specification will be between about 0.3 mm and 0.7 mm, preferably 0.5 mm.

According to a first aspect of the invention there is provided a heeled bullet for use in a rimfire ammunition cartridge, characterized in that the bullet, including its heel, is encased in a heavy metal jacket.

The bullet may be of lead and the jacket may be of a malleable copper alloy.

The bullet may be of .22 caliber for use in a .22 long rifle cartridge.

Preferably, the bullet comprises a heel portion, a nose portion tapering towards a radiused end and a cylindrical body portion therebetween.

The bullet may have the following nominal dimensions:

| | |
|---|---|
| length of the cylindrical body portion | 3.45 mm |
| diameter of the cylindrical body portion | 5.67 mm |
| length of nose portion | 5.85 mm |
| length of heel portion | 2.40 mm to 2.60 mm |
| diameter of heel portion | 5.30 mm. |

A step may be defined between the nose and the body portion. Then, in a preferred embodiment of the invention, the nose portion has a maximum nominal diameter of 5.27 mm at the point where it meets the body portion.

The heavy metal jacket may have a thickness of between about 0.3 mm and 0.7 mm, preferably about 0.5 mm.

The bullet weight of the bullet may vary according to requirements, and may be, for example, 25, 36, 40 or 180 grains. In a preferred embodiment of the invention, the bullet has a nominal weight 40 grains or about 2.5919 gms.

According to another aspect of the invention there is provided an ammunition cartridge comprising:

a rimfire cartridge casing having a closed operatively back end and an open operatively front end; and a heeled bullet characterized in that the bullet, including its heel, is encased in a heavy metal jacket, the heel of the bullet being received in the open end of the cartridge.

BRIEF DESCRIPTION OF THE DRAWINGS

The invention will now be described, by way of example only, with reference to the accompanying diagrammatic drawings in which.

DETAILED DESCRIPTION OF THE DRAWINGS

Figure 1:
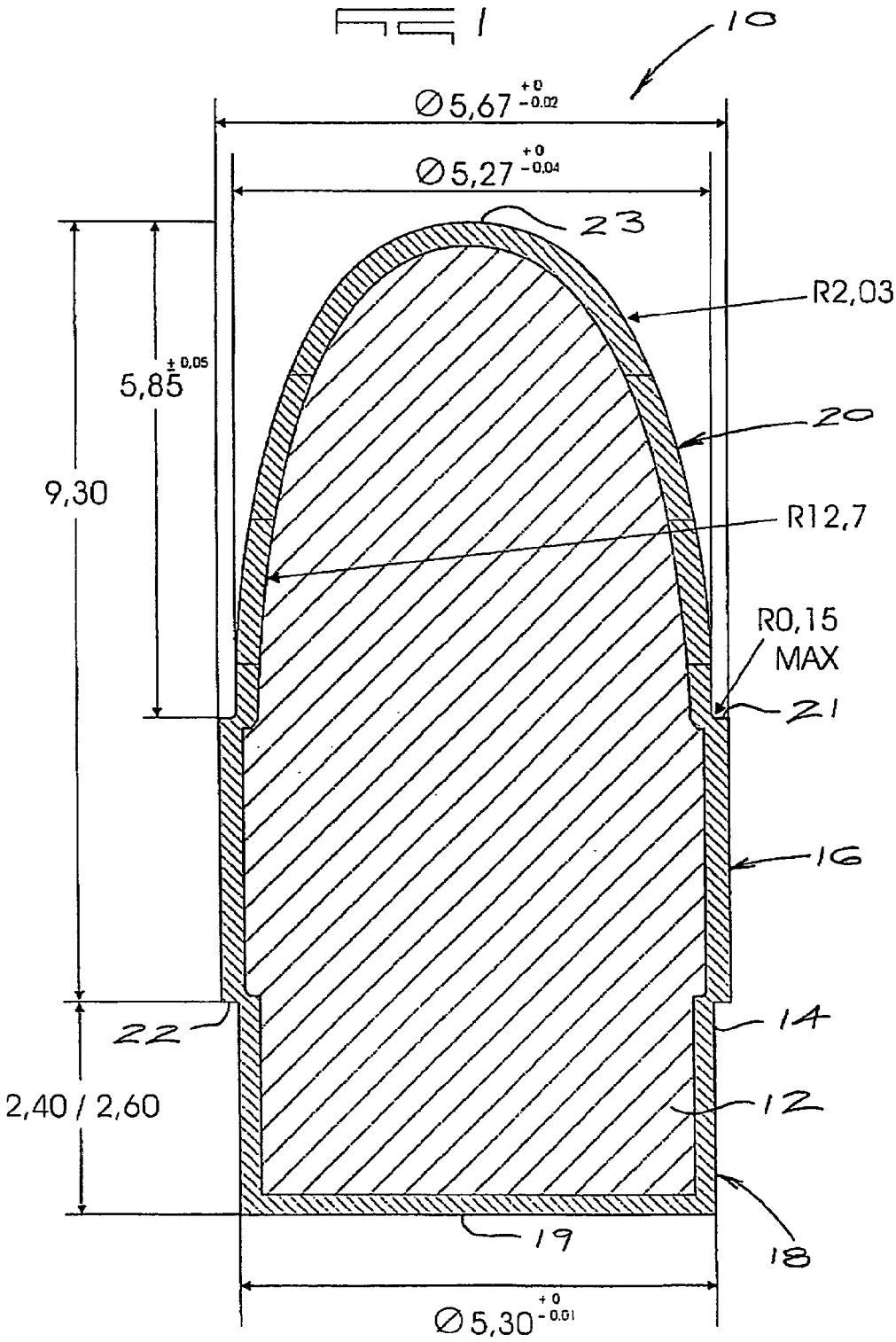
FIG. 1 is a sectional side elevation of a bullet in accordance with the invention.

In the drawings, a .22 caliber long rifle bullet in accordance with a first aspect of the invention is generally referred to by reference numeral (10). The bullet (10) is made from a lead core (12) covered by a heavy metal jacket (14) made from a malleable copper alloy. Three distinct zones can be distinguished on the bullet (10): a centrally disposed cylindrical body portion (16), a narrowed heel (18) and a nose (20) that tapers inwardly towards a radiused end (23). All dimensions indicated on the drawings are in mm.

The cylindrical body portion (16) has a length of 3.45 mm, the nose (20) a length of 5.85 mm and the heel (18) a length of between 2.40 mm to 2.60 mm. The widest part of the bullet (10) is the body portion (16) which has a diameter of 5.67 mm. A step (21) is defined between the nose (20) and the body portion (16), where the maximum diameter of the nose (20) is 5.27 mm (+0, −0.04) at the point where it meets the body portion (16). The heel portion (18) is inwardly stepped relative to the body portion (16) to form a shoulder (22) therebetween. The heel portion (18) has a diameter of 5.30 mm and is generally right circular cylindrical, terminating in a flat base (19). All of the aforementioned lengths are nominal lengths and the tolerances indicated on FIG. 1 are those of the preferred embodiment described. The entire bullet (10) is covered by the heavy metal jacket (14), which has a thickness of about 0.5 mm. The overall weight of the bullet is 40 grains or about 2.5919 grams.

Figure 2:
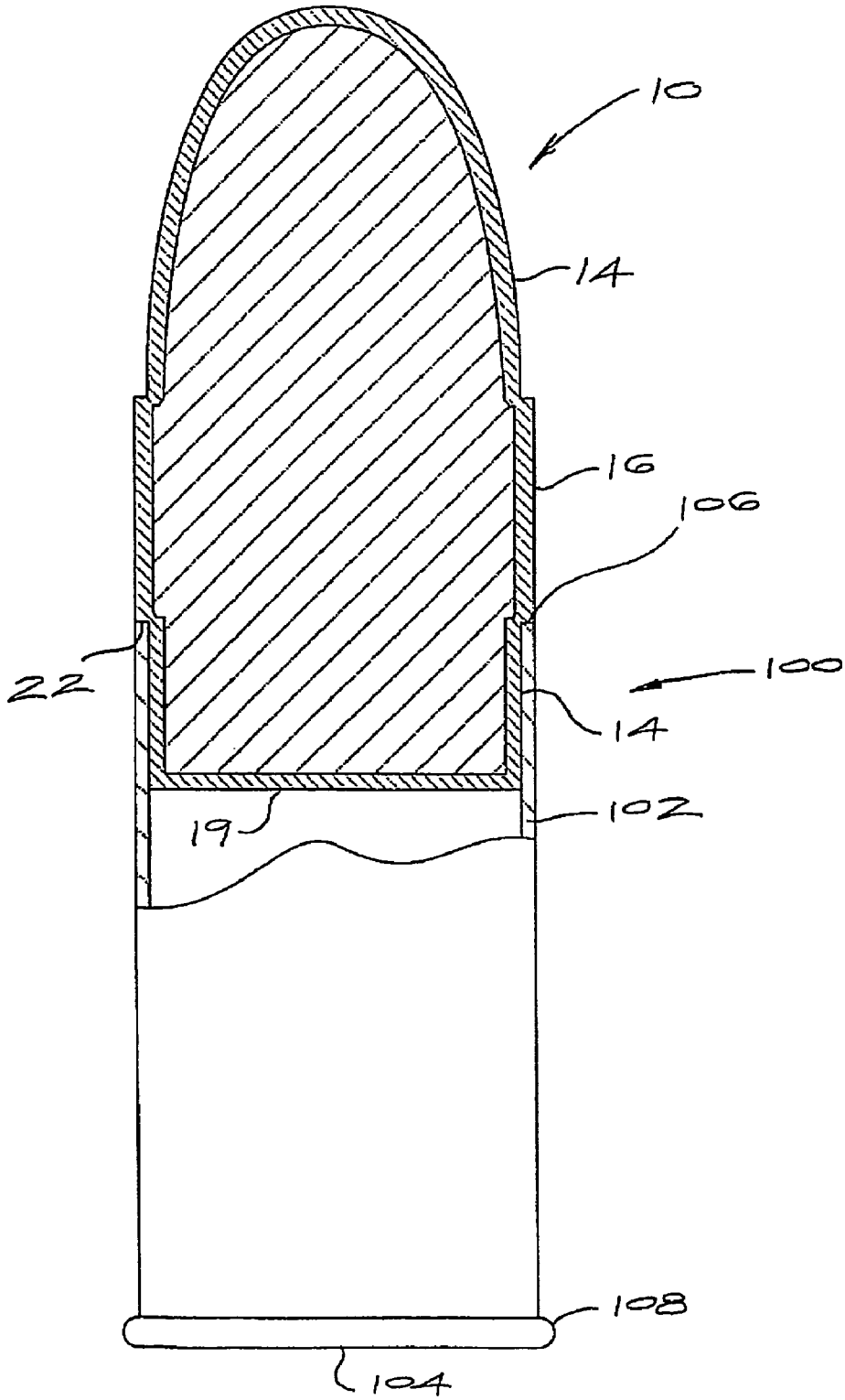
FIG. 2 is a sectional side elevation of an ammunition cartridge in accordance with the invention having the bullet of FIG. 1.

FIG. 2 shows an ammunition cartridge (100) in accordance with a further aspect of the invention. The ammunition cartridge (100) has a rimfire cartridge casing (102) into which the bullet (10) of FIG. 1 is fitted. The casing (102) has a closed, operatively back end (104) and an open, operatively front end (106). The back end (104) has a flanged rim (108) in which a priming compound is provided, and the remainder of the casing (102) contains a propellant. The heel (18) of the bullet (10) fits into the open end (106) of the casing (102) so that the rim of the open end (106) abuts the shoulder (22) of the bullet (10) and the heel (18) is housed within the casing (102). The outside diameter of the casing (102) corresponds with the diameter of the body portion (16) of the bullet (10), so that the body portion (16) forms a bearing surface that is flush with the casing (102).

In use, the ammunition cartridge (100) is chambered in the barrel of a firearm (not shown) with substantially the entire length of the cartridge (100) extending into the barrel and the flanged rim (108) abutting a bearing surface at the breech end of the barrel. The barrel is dimensioned so that the body portion (16) and the cartridge casing (102) form a snug fit against the inner surface of the barrel. The cartridge (100) is fired when a striking pin strikes the rim (108) of the casing (102), deforming the rim (108) and igniting the primer (not shown). The primer in turn ignites the propellant (not shown), and expanding gasses cause the bullet (10) to be propelled out of the casing (102) and down the barrel of the firearm.

The heavy metal jacket (14) that encases the bullet (10), including its heel (18), inhibits the heel (18) from deforming and expanding immediately after the cartridge (100) is fired and while the bullet (18) is traveling down the barrel. This avoids the problems associated with an expanding heel outlined above. In addition, the heavy metal jacket (14) protects the base (19) of the bullet from the corrosive forces of the hot gasses. The copper alloy in the heavy metal jacket (14) also renders lubrication of the bullet (10) unnecessary, thereby avoiding the contamination problems associated with grease or wax lubrication in existing heeled bullets. Furthermore, the metal jacket (14) protects the bullet (10) against distortion or damage during manufacture or use. Because the bullet distorts less during firing, the accuracy of the round is improved. The harder material also results in the bearing surface body portion (16) forming a better gas seal against the barrel than existing heeled non-jacketed bullets. The jacketed bullet (10) also has better penetration characteristics than a non-jacketed bullet.

The barrel of a firearm is generally rifled and a series of lands and grooves is defined on the inner surface of the barrel of the firearm. In higher pressure ammunition cartridges, it may happen that the rotational inertia of the bullet overcomes the rotational forces that the lands and grooves impart to the bullet, so that the bullet does not properly rotate. Instead, the lands and grooves cut across the bullet. This is known as "stripping". Because of its harder material, the jacketed bullet of the invention has better grip in the lands and grooves of the barrel and is not as prone to stripping.

The invention claimed is:

1. A heeled bullet for use in a rimfire ammunition cartridge, wherein the bullet, including its heel, is encased in a metal jacket of between about 0.3 mm and 0.7 mm in thickness, thereby to substantially inhibit deformation of the jacketed heel under firing.

2. The bullet as claimed in claim 1 which is of lead and in which the jacket is of a malleable copper alloy.

3. The bullet as claimed in claim 2 which is of .22 caliber for use in a .22 long rifle cartridge.

4. The bullet as claimed in claim 3 comprising a heel portion, a nose portion tapering towards a rounded end and a cylindrical body portion therebetween.

5. The bullet as claimed in claim 4 having the following nominal dimensions:

| | |
|---|---|
| length of the cylindrical body portion | 3.45 mm |
| diameter of the cylindrical body portion | 5.67 mm |
| length of nose portion | 5.85 mm |
| length of heel portion | 2.40 mm to 2.60 mm |
| diameter of heel portion | 5.30 mm. |

6. The bullet as claimed in claim 5 in which a step is defined between the nose and the body portion.

7. The bullet as claimed in claim 6 in which the nose portion has a maximum nominal diameter of 5.27 mm at the point where it meets the body portion.

8. The bullet as claimed in claim 3 in which the metal jacket has a nominal thickness of about 0.5 mm.

9. The bullet as claimed in claim 8 having a weight of about 2.5191 grams.

10. An ammunition cartridge comprising:

a rimfire cartridge casing having a closed operatively back end and an open operatively front end; and a heeled bullet, wherein the bullet, including its heel, is encased in a metal jacket of between about 0.3 mm and 0.7 mm in thickness, the heel of the bullet being received in the open end of the cartridge, thereby to substantially inhibit deformation of the jacketed heel under firing.

11. The ammunition cartridge as claimed in claim 10 wherein the bullet is of lead and in which the jacket is of a malleable copper alloy.

12. The ammunition cartridge as claimed in claim 11 which is of .22 caliber for use in a .22 long rifle cartridge.

13. The ammunition cartridge as claimed in claim 12 wherein the bullet comprises a heel portion, a nose portion tapering towards a rounded end and a cylindrical body portion therebetween.

14. The ammunition cartridge as claimed in claim 13 in which the bullet has the following nominal dimensions:

| | |
|---|---|
| length of the cylindrical body portion | 3.45 mm |
| diameter of the cylindrical body portion | 5.67 mm |
| length of nose portion | 5.85 mm |
| length of heel portion | 2.40 mm to 2.60 mm |
| diameter of heel portion | 5.30 mm. |

15. The ammunition cartridge as claimed in claim 14 in which a step is defined between the nose and the body portion of the bullet.

16. The ammunition cartridge as claimed in claim 15 in which the nose portion has a maximum nominal diameter of 5.27 mm at the point where it meets the body portion.

17. The ammunition cartridge as claimed in claim 12 in which the metal jacket of the bullet has a nominal thickness of about 0.5 mm.

18. The ammunition cartridge as claimed in claim 17 wherein the bullet has a weight of about 2.5191 grams.

* * * * *